US006463958B1

(12) United States Patent
Schwing

(10) Patent No.: US 6,463,958 B1
(45) Date of Patent: Oct. 15, 2002

(54) DISTRIBUTING DEVICE FOR THICK SUBSTANCES, ESPECIALLY CONCRETE

(75) Inventor: Friedrich Schwing, Gelsenkirden (DE)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 09/830,322

(22) PCT Filed: Oct. 15, 1999

(86) PCT No.: PCT/EP99/07850

§ 371 (c)(1),
(2), (4) Date: Jul. 10, 2001

(87) PCT Pub. No.: WO00/24988

PCT Pub. Date: May 4, 2000

(30) Foreign Application Priority Data

Oct. 28, 1998 (DE) ..... 198 49 747

(51) Int. Cl.[7] ..... B65G 53/32
(52) U.S. Cl. ..... 137/615; 141/387
(58) Field of Search ..... 137/615, 899; 141/387, 388

(56) References Cited

U.S. PATENT DOCUMENTS 4,130,134 A * 12/1978 Castle ..... 137/615
4,548,236 A 10/1985 Bloomquist
6,142,180 A * 11/2000 Woodling et al. ..... 137/615

FOREIGN PATENT DOCUMENTS

EP 0 432 854 A1 6/1991

* cited by examiner

*Primary Examiner*—Kevin Lee
(74) *Attorney, Agent, or Firm*—Kinney & Lange, P.A.

(57) ABSTRACT

In a distribution device intended in particular for concrete distribution, a scissor-like assembly of conveying-conduit elements is provided to ensure lengthwise adjustment of the concrete-conveying conduit to a telescopic distribution-boom section which supports the concrete-conveying conduit. The scissor assembly is designed such that the articulation points of the conveying-conduit elements move past each other while the telescope is being extended or retracted from one end position to the other, and alternately assume transposed positions when the telescope is fully retracted or fully extended. The conveying-conduit elements will always assume an extended position, either against the direction of concrete conveyance or in the direction of concrete conveyance, when the telescope is either fully retracted or fully extended.

10 Claims, 8 Drawing Sheets

F
F 5
3
4
F
13
17
15
12
10
9
III
I
4
4
3
C
$B_0$
$A_0$
10
Δh
15
II
9
III
$B_1$
$A_1$
15
10
F
$C_1$
12
9
13
15
$C_2$
ROLL FOLDING
10
12
$C_3$
Z-TYPE FOLDING
10
15
$C_4$
12
$C_5$
TELESCOPIC TRAVEL
TELESCOPIC TRAVEL 2
3
4
15
25
12
10
26
10'
9'
24
12'
15'
13'

10
9
12
13
15

DISTRIBUTING DEVICE FOR THICK SUBSTANCES, ESPECIALLY CONCRETE

FIELD OF THE INVENTION

The invention relates to a distribution device as for slurries, especially concrete. The distribution device has a distributing boom supporting a concrete-conveying conduit. The distributing boom consists of several sections, which can be folded towards each other. At least one of the several sections is telescopic, having at least a first telescopic pipe and a second telescopic pipe that can be extended from the first telescopic pipe. The concrete-conveying conduit is designed in the region of the telescopic distributing boom section as a system consisting of several articulated conveying-conduit elements in order to ensure lengthwise adjustment of the concrete-conveying conduit to the telescopic movement. One of said conveying-conduit elements is articulated at one end with the first telescopic pipe. The other conveying-conduit element is articulated at one end with the second telescopic pipe. The articulation points of the two conveying-conduit elements are articulated with the two telescopic pipes. The two telescopic pipes alternately assume essentially transposed positions in the two telescopic end positions, so that the one telescopic pipe is retracted and extended into its telescopic end positions, the two articulation points move past one another. The conveying-conduit elements are extended against the direction of concrete conveyance in one telescopic end position and in the direction of concrete conveyance in the other telescopic end position.

BACKGROUND OF THE INVENTION

Such distribution devices are used in particular to convey concrete in building construction, for example, to pour concrete ceilings in buildings. Depending on the height and size of the building, the concrete may have to be distributed over a wide area. For this purpose, distribution systems are used, which are mounted on a transport vehicle, a crane or the like and which mostly consist of a distribution boom divided into several boom sections. The prime concern in respect of the distribution booms is to achieve maximum distribution reach for concrete conveyance, a requirement satisfied by skillful division of the boom into individual boom sections that are connected with each other in an articulated or telescopic manner.

This is why highly sensitive, articulated distribution booms are a characteristic of mobile concrete pump systems. The distribution booms are disposed on a pivot mounting and support a concrete-conveying conduit. Such distribution booms can assume the most varied types of work positions that may be required at the job site, e.g. vertical or horizontal extension, angular positions, etc. Regardless of their configuration, the booms thus enable the delivery end of the concrete-conveying conduit to be guided precisely to the place at which the concrete is to be poured. The tip of the distribution boom is guided by turning the latter and/or adjusting the angles between the individual boom sections.

The distribution boom's high degree of mobility is especially important at its front end, i.e. in the vicinity of concrete delivery. For the section nearer the pivot mounting, by contrast, the telescopic function is more important because of the height and width of reach that it permits. In this context, it has proved expedient to design at least one section of the distribution boom, preferably the basic boom, as a telescopic section. Compared to the alternative of bringing the boom sections into angular positions, this solution has the advantage of requiring less space.

For the telescopic section of the distribution boom, provisions must be made for lengthwise adjustment of the concrete-conveying conduit. Of course, lengthwise adjustment may be achieved by using flexible concrete-conveying-conduit elements in the region of the telescopic boom section. Such a solution, however, is restricted to small extension/retraction lengths, since flexible concrete-conveying conduits can only be bent to a limited extent. In cases involving greater extension/retraction lengths, such a design is out of the question. Here, rigid concrete-conveying-conduit elements must be used instead.

In a known distribution device of the same type, described in U.S. Pat. No. 4,130,134, the distribution device is supported on a pivot mounting of a truck. This distribution device has a telescopic basic boom, and lengthwise adjustment of the concrete-conveying conduit is achieved by means of a scissor-type system consisting of several conveying-conduit elements. The known scissor-type conveying conduit for lengthwise adjustment to the telescopic travel of the basic boom uses at least three conveying-conduit elements which are connected in series. The conveying-conduit elements are arranged in such a manner that they can be folded variably between a fully folded position when the telescopic section is fully retracted and a fully extended position, when the telescopic section is fully extended. During the telescopic process, every conveying-conduit element swings by about 180° and, at one stage, assumes a position perpendicular to the telescopic axis. The known scissor-type conveying conduit requires at least three conveying-conduit elements, of which the two outer elements are each articulated at one end with the central conveying-conduit element. With their respective other ends, the outer elements are connected with the respective telescopic section of the distribution boom and there with the concrete-conveying conduit that supplies or carries off the concrete. Basically, however, these two outer of the three conveying-conduit elements are insignificant for lengthwise adjustment to the telescopic travel. Compared to the telescopic pipes which support them, the outer elements only perform an insignificant dodging movement perpendicular to the longitudinal axis of the telescope and only move to the extent to which the articulation points with the central conveying-conduit element move away at right angles from the telescope's longitudinal axis during the telescopic process. Thus, lengthwise adjustment to the telescopic boom section is effected exclusively by the swiveling of the middle conveying-conduit element. This middle element is supported centrally on a member which is guided on the distribution boom in longitudinal direction, and because of the arrangement surrounding the boom profile, can only swing up to about 120°. As a result, only about 1.7 times the actual length of the central conduit element can be used for lengthwise adjustment to the telescopic boom section. If the telescopic boom section is extended by approximately 50%, a position at which the central conveying-conduit element forms an angle of approximately 90° to the telescopic boom section, this concrete-conveying-conduit element protrudes on both sides of the distribution boom by approximately one-fourth of the telescopic length, so that the entire system size of such a device amounts to approximately half the telescopic length. With telescopic lengths of 4 to 6 m commonly encountered in practice, this is extremely irritating.

The U.S. Pat. No. 4,130,134 does in fact suggest an alternative two-fold scissor-type conveying conduit for systems involving great telescopic lengths or multiple telescopic sections. However, this suggestion has the disadvantage that for each additional scissor-type conveying conduit, additional conveying-conduit elements would have to be used, i.e. one element relevant for lengthwise adjustment to the telescopic boom and one intermediate connecting element which is irrelevant for lengthwise adjustment. This inevitably adds considerably to the cost of the construction and requires a complex arrangement of concrete-conveying-conduit elements.

The known concrete distribution device thus has the disadvantage that widthwise it requires rather a lot of space. This presents a problem in view of the fact that with such distribution devices a large number of folded boom sections together with the multisection concrete-conveying conduit they support and further distribution-device accessories must be accommodated in a very confined space. Accordingly, increased importance is attached to a more compact and simple design of such distribution devices with a telescopic boom section.

It has been suggested that the concrete-conveying conduit itself be designed with a telescopic function (German patent specification 196 41 789). This, however, involves the problem that in the telescopic section, the concrete hardens between the inside and outside concrete-conveying conduits. This seriously interferes with conduit retraction and extension and with cleaning, and may even render these actions impossible. The guidance of the telescopic conduit sections into one another and the problems associated with their roundness have so far prevented such a design from being implemented in practice.

Finally it is known from U.S. Pat. No. 3,942,554 that in the case of a telescopically adjustable crane boom supporting a conveying conduit, the conduit length can be adjusted as the crane boom is extended or retracted by articulating two movable interconnected conduit sections with the front and rear ends of the telescopic boom section in such a way that the conveying conduit folds and unfolds with Z-like movement when the crane boom is retracted/extended (cf. FIG. 1 and FIGS. 6 and 7). When the boom is retracted, the conveying-conduit elements move from their extended position—which, when the boom is fully extended, is approximately parallel to the telescopic direction—to a position which, when the boom is fully retracted, is approximately perpendicular to the telescopic direction, or vice versa. During this process, the conveying-conduit elements swing by approximately 90°, which would necessarily result in a system height of approximately half the telescopic length. For telescopic lengths of 4 to 6 m, which are commonly encountered in practice, such a design would be exceptionally irritating, since it requires a lot of space during unfolding of the system and, besides, involves increased constructional costs.

EP-A 432 854 describes a distribution device of the same type, in which two conveying-conduit elements are in a transposed position relative to each other in one telescopic end position and are on a sloping plane relative to each other in the other telescopic end position. The two conveying-conduit elements move past each other during the extension of the one telescopic element. However, the assembly consisting of the two interconnected conveying-conduit elements is relatively awkward in shape, which in view of the many moving parts combined in the distribution device is disadvantageous and irritating during unfolding or extension of the boom.

BRIEF SUMMARY OF THE INVENTION

The object of this invention is to provide a distribution device, especially suitable for concrete conveyance, which is of relatively simple and structurally compact design and allows lengthwise adjustment of a concrete conveying conduit to a telescopic supporting boom.

This object is established according to the invention by means of the features contained in the characterizing part of claim 1 with useful embodiments being characterized by the features contained in the subclaims.

As provided for by the invention, each conveying-conduit element is designed such that its end portions curve in the same direction and point towards the end portions of the other conveying-conduit element. This results in an essentially "S-shaped" design when the conveying-conduit elements are in extended position. This leads to a highly compact design, which is very advantageous for the distribution device because the latter has many moving parts which must not impede each other when the boom sections are extended or unfolded. The articulation points of the two conveying-conduit elements articulated with the telescopic pipe alternately assume essentially transposed positions when the telescopic pipe is either fully retracted or fully extended. During extension or retraction of the extensible telescopic pipe into its end positions, the two articulation points of the conveying-conduit elements move past each other with the conveying-conduit elements assuming an extended position in both telescopic end positions, in one end position against the direction of concrete conveyance and in the other end position in the direction of concrete conveyance.

The two conveying-conduit elements, which are relevant for lengthwise adjustment, have a length equal to about one-fourth of the travel of the telescopic boom section. During the entire telescopic process, each of the conveying-conduit elements moves by approximately 180°, thus assuming at one stage a position perpendicular to the telescopic direction. Application of the roll-folding principle provided for by the invention ensures that the two conveying-conduit elements never assume this vertical position simultaneously but always one after the other. This means that the height of the system, i.e. the space required, amounts to approximately one-fourth of the telescopic travel or roughly the length of one conveying-conduit element. This is advantageous for compact scissor-type conveying-conduit design. Not only can the entire system height depending on the number of conveying-conduit elements, amount to only approximately one-fourth or less of the telescopic travel, but, what is more, the system does not require any intermediate pieces, so that additional constructional costs associated therewith are avoided. Overall, this also reduces the number of moving parts and the necessary joints, as well as means to support them.

An additional advantage is that by freely determining the lengths of the conveying-conduit elements and their articulation with the two telescopic pipes which perform a sliding movement relative to each other, the scissor-type conveying conduit can be tailored to the situation predefined by the transport vehicle and the distribution boom to be used.

It has proved expedient if the points at which the conveying-conduit elements are articulated with the telescopic pipes that can be moved relative to each other are positioned at different heights (from each other), so that the articulation points of the conveying-conduit scissor form a statically defined triangle at each stage of telescopic movement. As a result, the forces acting upon the conveying-conduit elements are also statically defined at each stage. This is important for the design, stability and service-life of the structure. In this case, the articulation points move on exactly defined paths, with the fixed articulation points moving relative to each other on paths parallel to the telescopic direction.

Thus, the invention not only realizes the low system height which is crucial for complicated distribution booms and their motions but also makes it possible to tailor the design and arrangement of conveying-conduit elements relevant for lengthwise adjustment, and their articulations, to the constructional environment—a factor that is crucial in view of the complexity of today's concrete distribution booms. In this context, it must be borne in mind that there is relatively little room available for the installation and movement of concrete distribution devices consisting of various boom segments because parts of the drive system, such as cylinders, levers etc., which are required for swiveling the distribution boom, also have to be accommodated in this extremely confined area.

It has also proved expedient to design each conveying-conduit element roughly in the shape of a "C", so that two adjoining conveying-conduit elements that are directly connected with each other by means of an articulated joint, result essentially in an "S" or "wave shape" with two opposing amplitudes. This design allows the two elements to move past each other while requiring only little space.

BRIEF DESCRIPTION OF THE DRAWINGS

Embodiments of the invention are described below by reference to the enclosed drawings. The figures show the following.

DETAILED DESCRIPTION

Figures 1, 2, 3, 4:
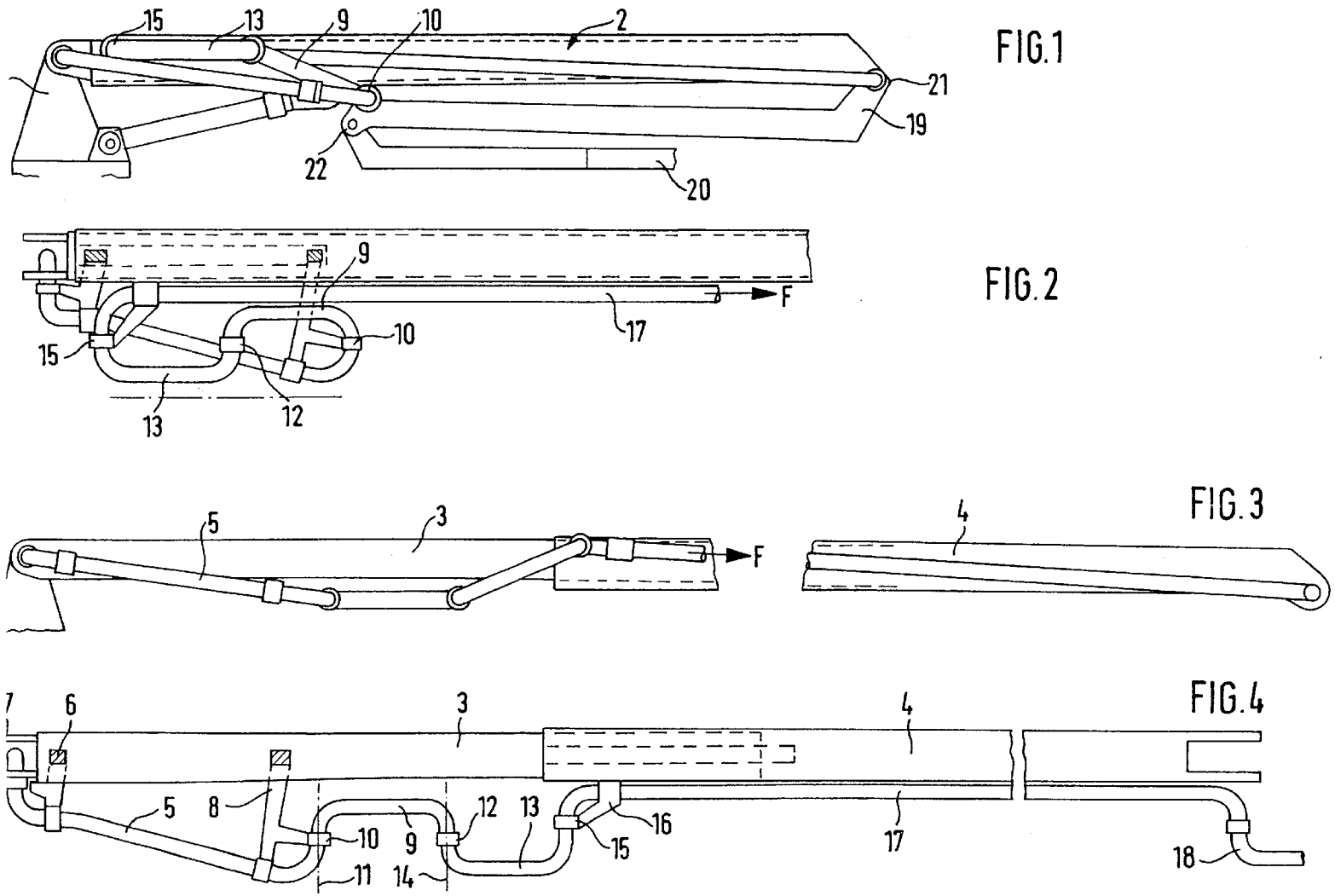
FIG. 1 is a schematic diagram showing a side view of part of a concrete-distribution boom with fully retracted telescope.
FIG. 2 shows a top view of the concrete-distribution boom of FIG. 1.
FIG. 3 shows a side view of the concrete-distribution boom of FIG. 1 with the telescope fully extended.
FIG. 4 shows a top view of the concrete-distribution boom of FIG. 3.

FIG. 1 is a purely schematic and partial representation of a distribution boom for slurries, in particular concrete, which, for example at 1, may be mounted on a transport delivery vehicle, for example a truck. Distribution booms of this kind are used to convey concrete at the job site with the help of a concrete pump, for example to pour a concrete ceiling. The distribution boom, which generally consists of several boom sections, has a wide reach thanks to swiveling motions and extension of individual sections. The distribution boom shown in the Figure has a telescopic boom section 2 which can swivel around element 1. As shown in FIG. 3, this telescopic boom section 2 consists of a first telescopic pipe 3 and a second telescopic pipe 4 which, in contrast to the former, can be extended. It is generally preferred that the extensible telescopic pipe, i.e. in this case telescopic pipe 4, is positioned extensibly within telescopic pipe 3. However, the arrangement shown in FIG. 3 is also possible, in which telescopic pipe 3 is positioned within telescopic pipe 4, such that telescopic pipe 4 overlaps telescopic pipe 3.

In this context, the concrete-distribution boom acts as a support for the actual concrete-conveying conduit which consists of several articulated concrete-conveying pipes. The invention relates to the concrete-conveying conduit at the telescopic distribution-boom section, since lengthwise adjustment of the former is required there, when the telescopic pipe is extended. Below, the concrete-conveying pipes situated in this section will be referred to as "conveying-conduit elements".

In the embodiment shown in FIGS. 1 to 4, the concrete-conveying conduit is positioned next to the distribution boom 2. As shown best in FIG. 4, the conduit consists of a concrete-conveying pipe 5, which is fastened at 6 to the telescopic pipe 3. By virtue of the hinged joint 7, the concrete-conveying pipe can swivel to the same extent as the telescopic distribution-boom section 2. At its other end, the concrete-conveying pipe 5 is connected by means of a bracket 8 with the telescopic pipe 3. Adjoining this concrete-conveying pipe 5 is a conveying-conduit element 9, which at its one end, at 10, is rotatably hinged to bracket 8 but cannot be moved in longitudinal direction otherwise.

This means that conveying-conduit element 9 can swivel about axis 11. This conveying-conduit element 9, which at its one end, at 10, is rotatably fixed to telescopic pipe 3 is articulated at 12 directly with another conveying-conduit element 13. The swiveling axis has the reference numeral 14. At its other end, at 15, the second conveying-conduit element 13 is in turn rotatably hinged to a bracket 16, i.e., it can swivel but not otherwise move in longitudinal direction. Bracket 16 is fastened to the extensible telescopic pipe 4. A concrete-conveying pipe 17 adjoining conveying-conduit element 13 is also fastened to this bracket 16. The following section of the concrete-conveying conduit is indicated by reference numeral 18 but is not described in more detail.

FIGS. 1 and 2 show the telescopic distribution-boom section 2 with the telescopic pipe fully retracted. As can be seen, additional folded or rolled up boom sections 19 and 20 adjoin this boom section 2 in a familiar manner, and after extension and swiveling of telescopic boom section 2 can be unrolled or unfolded upwards or forwards. The necessary hinges have the reference numerals 21 and 22. Further explanations, however, are not required here, and any additional concrete-conveying conduits which may be supported by these boom sections 19 and 20 are not shown here either.

When the telescope is fully retracted as in FIGS. 1 and 2, the conveying-conduit elements 9 and 13 are extended, rearwards in the opposite direction to the direction of concrete conveyance F. This means, the articulation point 15 at which one end of conveying-conduit element 13 is jointed is located to the left of articulation point 10 at which the end of the other conveying-conduit element 9 is jointed.

When telescopic pipe 4 is extended, conveying-conduit element 13 and its articulation point 15 move in the direction of the telescopic movement and, depending on the extent of telescopic extension, run past articulation point 10 at the end of the other conveying-conduit element 9. Articulation point 10 will not move since telescopic pipe 3 is stationary, i.e. not extensible. This depends on the scissor design of the two conveying-conduit elements 9 and 13, as will be explained in more detail later on with the help of the various embodiments shown in FIGS. 7 to 10. FIGS. 3 and 4 show that the articulation points 10 and 15 have assumed transposed positions now that telescopic pipe 4 is fully extended, i.e. articulation point 15, which in FIG. 1 is shown to the left of articulation point 10, is now situated to the right of articulation point 10 when telescopic pipe 4 is fully extended as shown in FIG. 4. This means, the two articulation points 10 and 15 of the scissor construction comprising the two conveying-conduit elements alternately assume transposed positions which will depend on whether the telescopic structure is either fully retracted or fully extended.

The structure described permits lengthwise adjustment of a concrete-conveying conduit to a telescopic distribution boom with a surprisingly simple and, above all, compact scissor-type conveying-conduit design.

Figure 5:
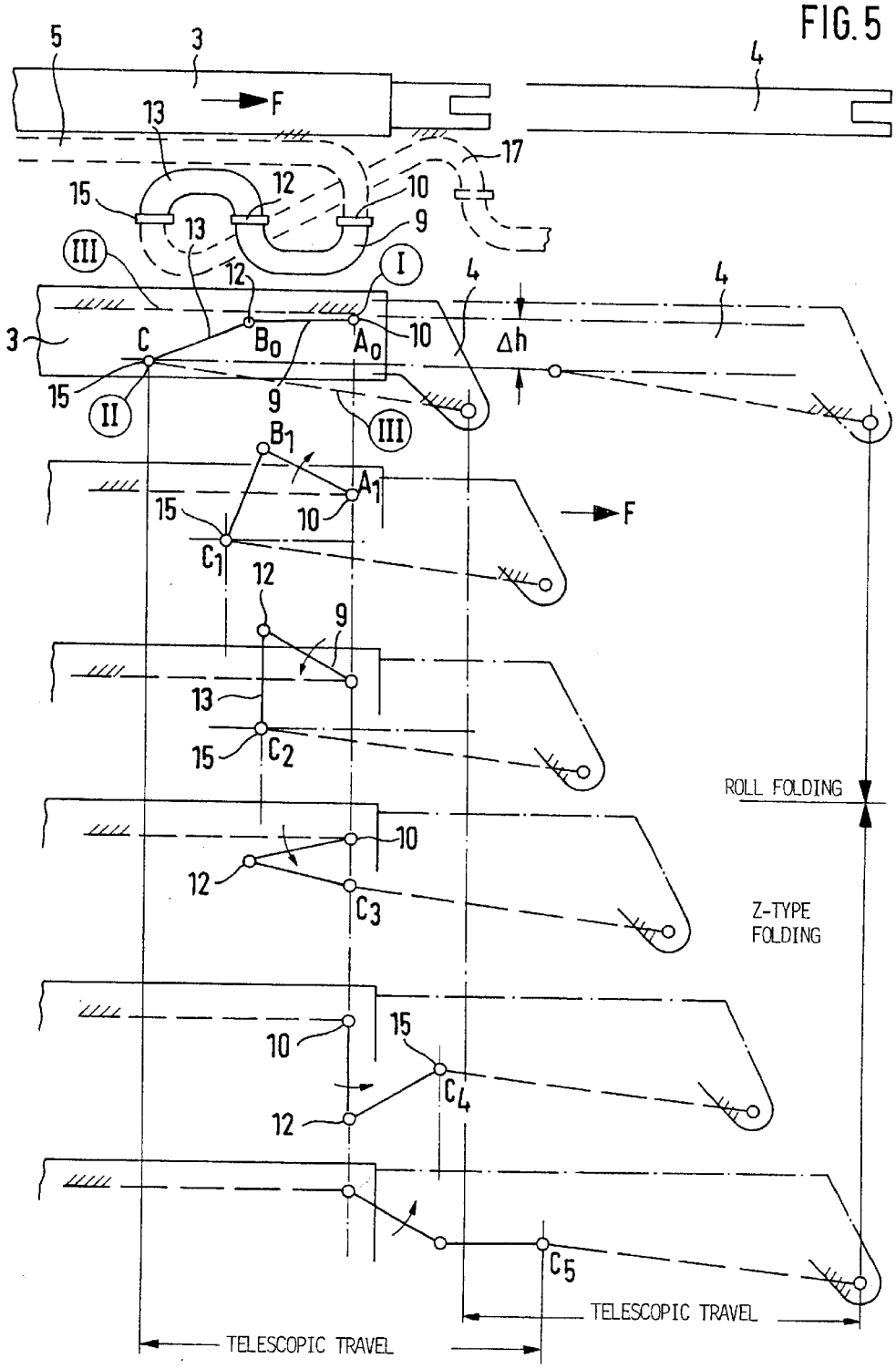
FIG. 5 is a schematic diagram of a concrete distribution boom and includes schematic diagrams of various telescope positions.

The top of FIG. 5 shows the basic design of a scissor-type conveying conduit consisting of conveying-conduit elements 9 and 13 as already explained by FIGS. 1–4, with the same reference numerals being used for the same components. At the top left of FIG. 5 the telescopic distribution boom is shown with the telescope fully retracted. At the right, the extended telescopic pipe is indicated schematically. Below, various telescopic positions of the scissor-type conveying conduit are shown with conveying-conduit elements 9 and 13 now schematically represented as straight lines to explain the functional working of the system. The figure shows how the ends of the two conveying-conduit elements 9 and 13 are firmly connected at points 10 and 15 to telescopic pipes 4 and 3 respectively, with the elements still being able to swivel within the joints. It can be seen that as telescopic pipe 4 commences to extend, conveying-conduit element 9 swings upwards and articulation point 15 moves to the right, in the direction of concrete conveyance F. The path of articulation point 15 runs on a straight line parallel to the telescopic axis of the telescope structure. It is evident that articulation point 15 is displaced downwards by a distance h relative to the stationary articulation point 10, so that the entire path of articulation point 15 is displaced by distance h. As the telescopic extension progresses, as shown in the following diagrams, articulation point 15 finally passes articulation point 10 and the scissor-type conveying conduit changes its position. From the functional position shown at the top of the Figure, in which the elements 9 and 13 are extended in the direction opposite the direction of concrete conveyance F, the elements now change round and extend in the direction of concrete conveyance F, as shown in the lower part of the Figure. Maximum excursion transverse to the direction of concrete conveyance F is reached, as shown in the Figure, when articulation point 15 is below the joint connecting the two elements 9 and 13. The transverse excursion is basically determined by the length of conveying-conduit element 13. Since, in a preferred embodiment, the two conveying-conduit elements can be of different lengths, it is possible—with respect to the configuration of a scissor-type conveying-conduit construction shown in FIG. 5—to select one conveying-conduit element 13 which is shorter than the other conveying-conduit element 9 or vice versa.

When telescopic pipe 4 is being retracted, the functional scheme proceeds from bottom to top until the scissor-type conveying conduit consisting of elements 9 and 13 has assumed its extended position against the direction of concrete conveyance F, as shown on the top of the page when the telescope is fully retracted.

Figure 6:
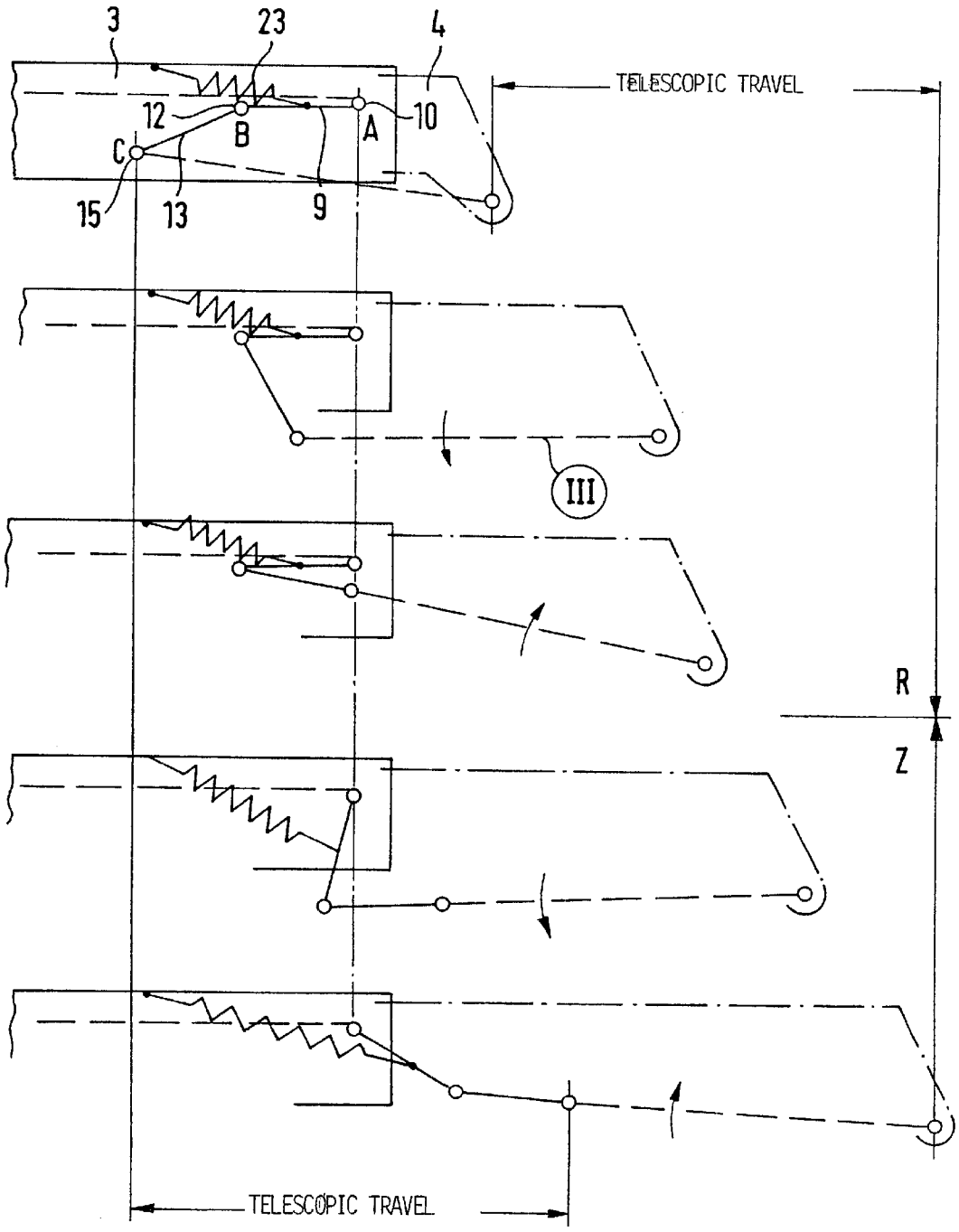
FIG. 6 shows a further embodiment analogous to FIG. 5.
Figure 7:
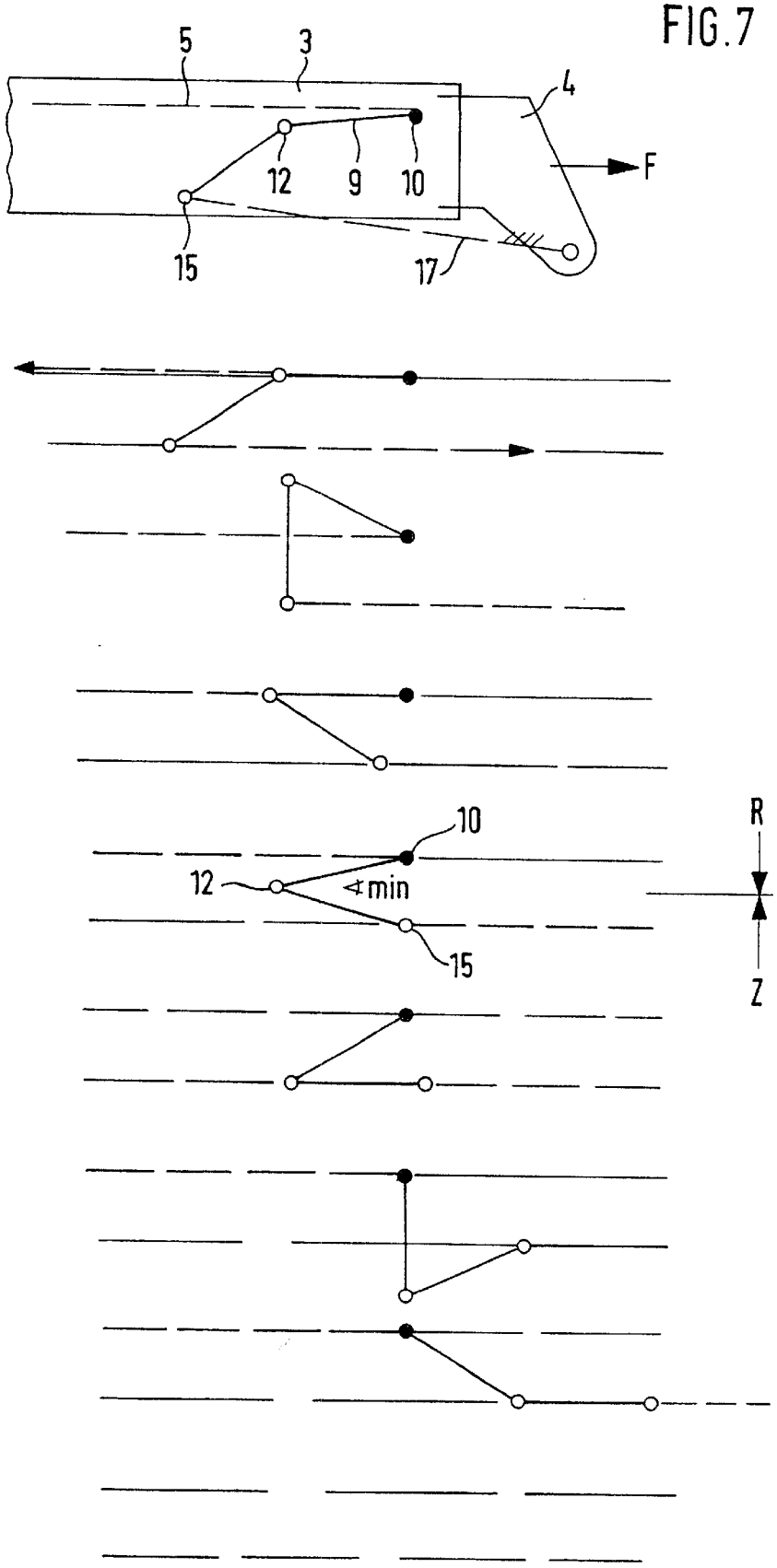
FIG. 7 shows an embodiment with the conveying-conduit elements arranged as characterized by the invention. Various intermediate stages of telescopic extension are shown below (functional diagram).
Figure 10:
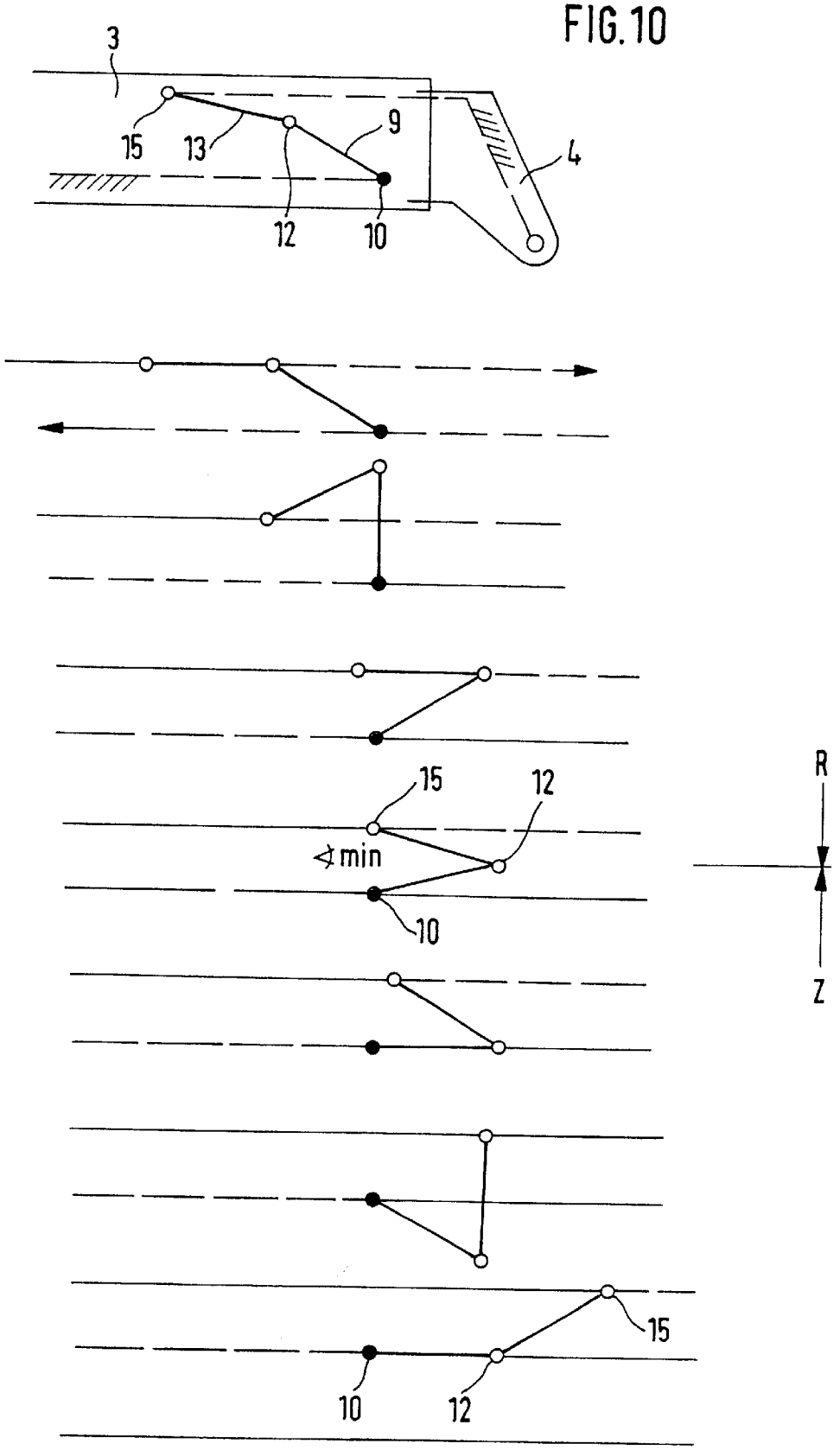
FIG. 10 shows another variant of FIG. 7.

FIG. 6 shows another preferred embodiment, in which an elastic swiveling moment acting against the scissor's unfolding movement is imposed on conveying-conduit elements 9 and 13. This can be achieved, for example, by providing a spring device 23, indicated only schematically here, which in the embodiment shown here is fastened at one end[2] to telescopic pipe 3 and at the other end jointed with conveying-conduit element 9. In this case, it is expedient, as in the embodiment shown here, to impose the elastic swiveling moment on the conveying-conduit element which at one end, here at articulation point 10, is connected with the non-extensible telescopic part, here telescopic pipe 3. This embodiment has a favorable impact on the stability of the scissor-type conveying conduit at all intermediate stages and its end positions. [2] inserted by translator FIGS. 7 and 10 show various embodiments of the scissor-type conveying-conduit system according to the invention, which can be selected to suit the situation defined by the way in which the system is mounted on the vehicle and which thus permits suitable adjustment to the overall design of the device. This makes it possible, for example, to determine and thus adjust the position or place at which, due to one of the conveying-conduit elements 9, 13, assuming a perpendicular position, the maximum width of the folded scissor-type conveying conduit is reached. Of course, this width can also be influenced by using conveying-conduit elements of different lengths.

In the embodiment shown in FIG. 7, conveying-conduit element 9 is fastened at its articulation point 10 to the stationary telescopic pipe 3. By contrast, articulation point 15 of element 13 is connected with the extensible telescopic pipe 4. In this case, when the telescope's end position is reached as shown at the top of FIG. 7, the joint between the two conveying-conduit elements 9 and 13 is angled slightly upwards.

The rough functional diagrams below show the various positions of the scissor-type conveying conduit during extension and retraction of telescopic pipe 4. It has proved altogether expedient, as shown in the middle functional diagram, to provide for a certain angular distance between the two scissors 9 and 13 at the point at which the two fixed articulation points 10 and 15 pass each other, i.e. if articulation points 10 and 15 are not in the same plane. This is achieved by having articulation points 10 and 15 displaced relative to each other, as shown in the diagram at the top of FIG. 7.

Figure 8:
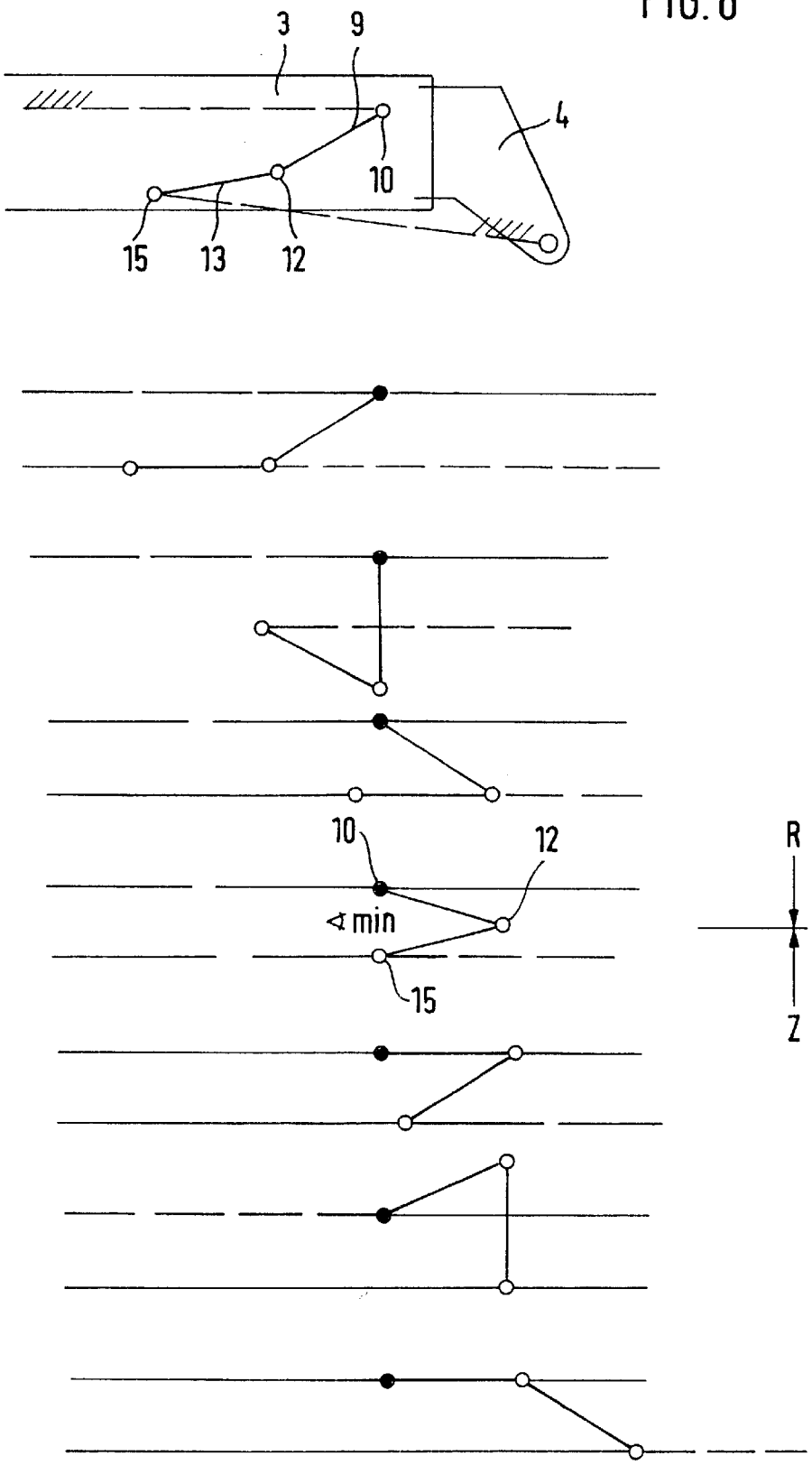
FIG. 8 shows another variant of FIG. 7.

In the embodiment shown in FIG. 8, the circumstances are analogous to the embodiment shown in FIG. 7. However, the joint between the two conveying-conduit elements 9 and 13 is angled downwards when telescopic pipe 4 is fully retracted. This results in different angular positions for articulation point 12 also when the telescope is fully extended, as can be easily seen when the diagrams at the bottom of FIGS. 7 and 8 are compared.

Figure 9:
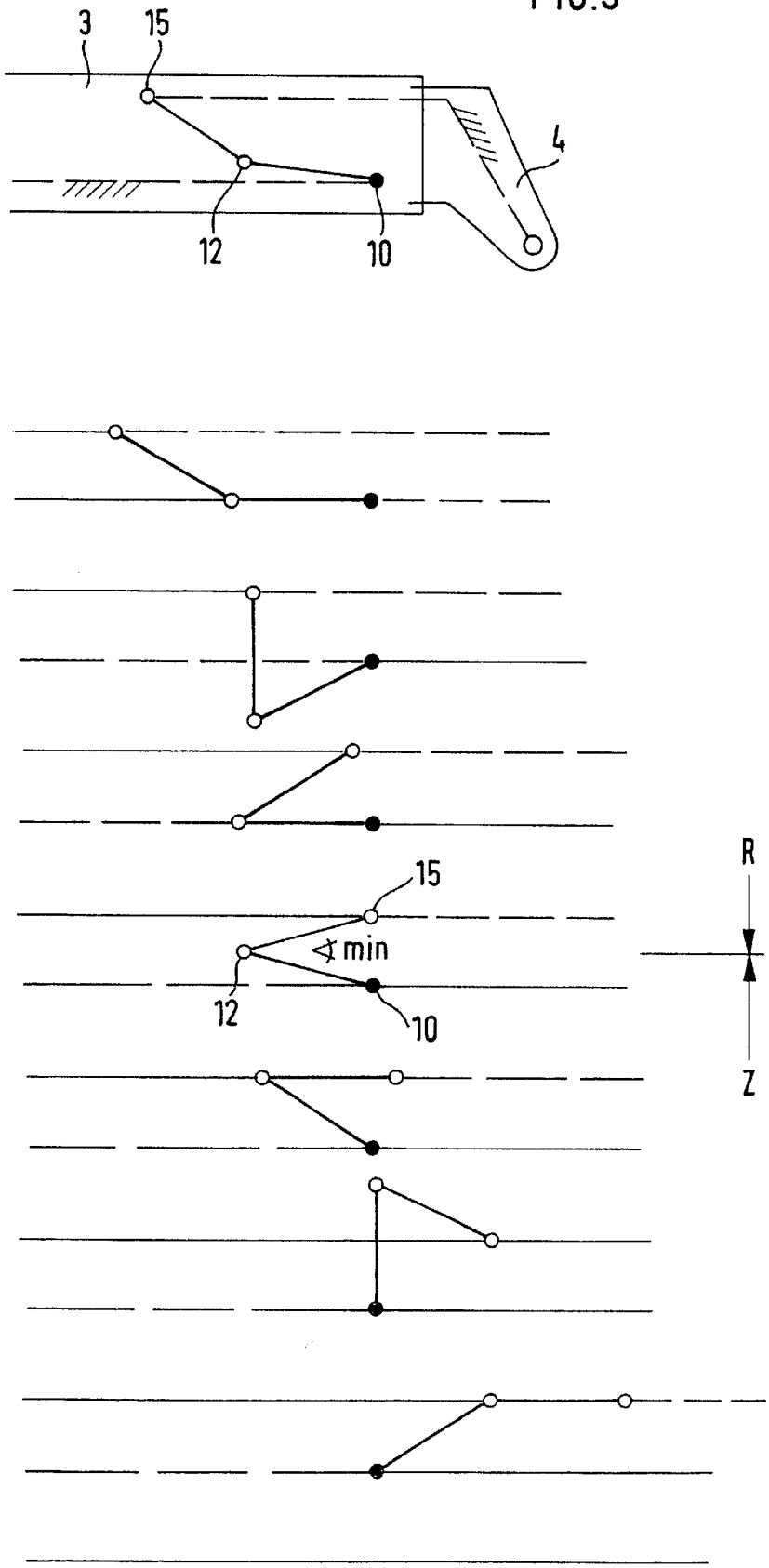
FIG. 9 shows another variant of FIG. 7.

In the embodiment according to FIG. 9, circumstances have been reversed as far as the articulation points of scissor elements 9 and 13 are concerned. Articulation point 10 which is fixed to the stationary telescopic pipe 3, is positioned at a clearly lower level than articulation point 15 and when the telescope is fully retracted the elements 9, 13 form a downwards angle. When the telescopic pipe is fully extended an upwards angle is formed, as shown in the diagram at the bottom of the page.

FIG. 10 shows a structure which is analogous to FIG. 9. However, the elements 9, 13 form an upward angle when the telescope of the scissor-type design is fully retracted.

Figure 11:
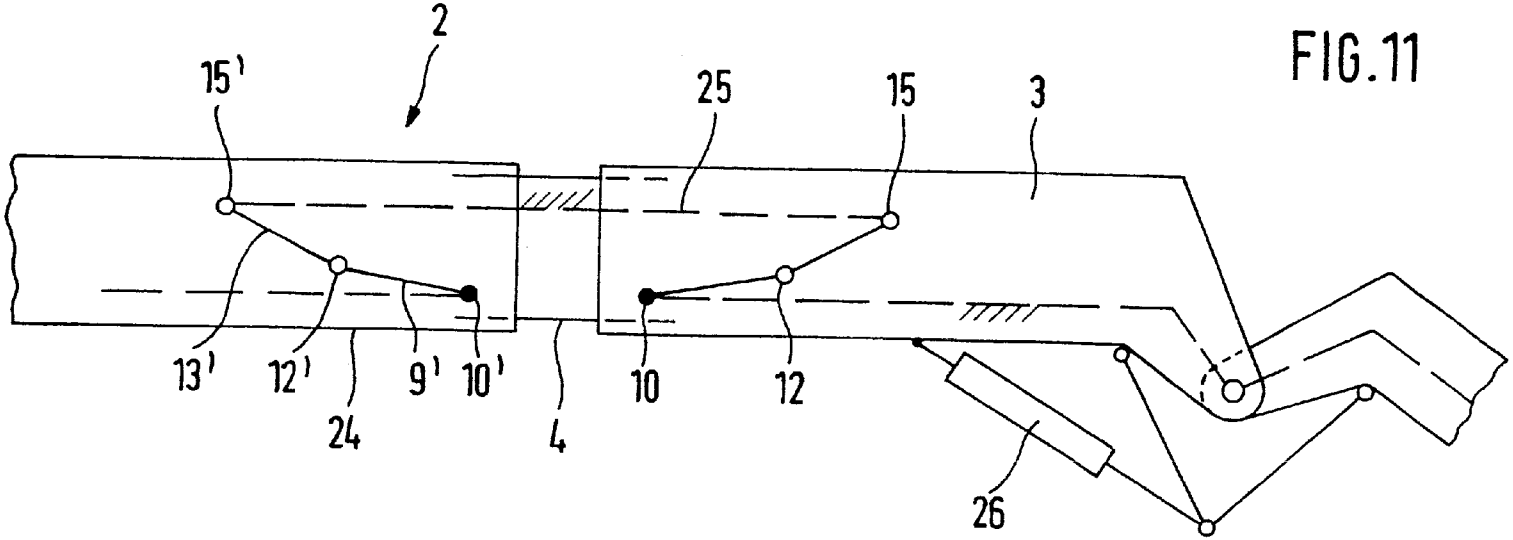
FIG. 11 shows a telescopic distribution-boom section consisting of three telescopic pipes as characterized by the invention.

FIG. 11 shows the structure of a telescopic distribution-boom section 2 consisting of three telescopic pipes, 3, 4 and 24. In this embodiment, two conveying-conduit scissors 9, 13 and 9', 13' are provided for lengthwise adjustment to the telescopic travel. The articulation points 15 or 15' are connected by means of a concrete-conveying pipe 25 shown by means of a dotted line. The two other articulation points are referred to as 10 and 10'. The conveying-conduit elements are connected with each other by means of an articulated joint referred to as 12 or 12'. In FIG. 11, reference numeral 26 refers to a hydraulic cylinder which serves for swiveling the boom section adjoining the telescopic boom section 2.

Figure 12:
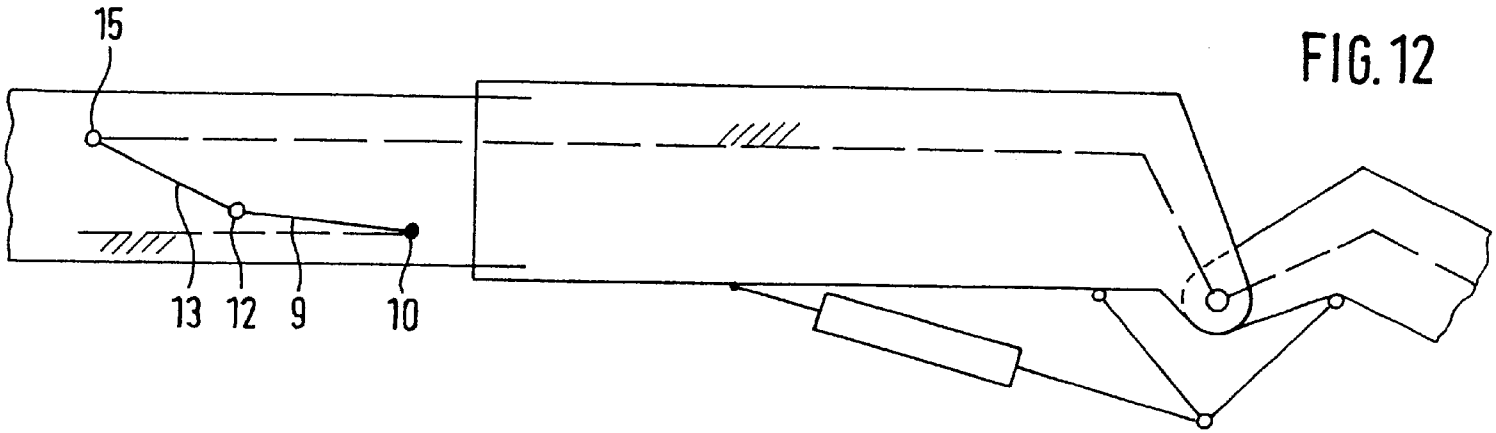
FIG. 12 shows a telescopic distribution boom of reverse arrangement.

Finally, FIG. 12 shows the embodiment of a conveying-conduit scissor 9, 13 with reverse arrangement of the distribution-boom telescope. This prevents a collision between the conveying-conduit system and the drive for articulating the distribution boom.

What is claimed is:

1. Distribution device for slurries having a distributing boom supporting a concrete-conveying conduit, said distribution boom consisting of several sections which can be folded towards each other and of which at least one section is telescopic and has at least a first telescopic pipe and a second telescopic pipe that can be extended from the former; and the concrete-conveying conduit being positioned in the region of the telescopic distributing boom section as a system consisting of at least two articulated conveying-conduit elements in order to ensure lengthwise adjustment of the concrete-conveying conduit to the telescopic movement; a first of said conveying-conduit elements being articulated at a first articulation point with the first telescopic pipe and a second conveying-conduit element being articulated at a second articulation point characterized in that the second telescopic pipe and the first and second articulation points alternately assume essentially transposed telescopic end positions, so that when the second telescopic pipe is retracted and extended between telescopic end positions, the first articulation point is moved past the second articulation point and the conveying-conduit elements are extended against the direction of concrete conveyance in a retracted telescopic end position and in the direction of concrete conveyance in an extended telescopic end position, each conveying-conduit element having two end portions which curve in the same direction and point towards the end portions of the other conveying-conduit element, so that the two articulated conveying-conduit elements essentially form an "S-shape".

2. Device according to claim 1, characterized in that the first and second articulation points are positioned at different heights relative to a telescope axis, such that there is a space between paths followed by the first and second articulation points during the telescopic movement.

3. Device according to claim 1, characterized in that each conveying-conduit element is designed essentially as a "C-shape" with a straight central piece and two end portions which curve in the same direction, and in extended position complement each other to form an "S-shape" or wave shape with two opposing amplitudes.

4. Device according to claim 1, characterized in that at least one of the conveying-conduit elements is spring-suspended from its corresponding telescopic pipe.

5. Device according to claim 1, characterized in that the telescopic distribution boom contains multiple telescopes and in that a pair of conveying-conduit elements is provided for each telescope.

6. An apparatus for distribution of concrete, the apparatus comprising:

a telescopic distributing boom having a plurality of sections which can be folded towards each other, one or more of the plurality of sections being a telescopic section capable of telescopic movement between a retracted telescopic position and an extended telescopic position, each telescopic section including a first telescopic pipe and a second telescopic pipe extendable from the first telescopic pipe;

a conveying conduit for distributing concrete to an end of the telescopic distributing boom, the conveying conduit extending lengthwise along the plurality of sections and being supported by the telescopic distributing boom; the conveying conduit comprising:

a first conduit element and a second conduit element for lengthwise adjustment of the conveying conduit during telescopic movement, each conduit element defining a curve with two ends pointing in a single direction, the first and second conduit elements positioned end to end so that the first and second conduit elements together essentially form an "S-shape", the first conduit element being articulated at a first articulation point on the first telescopic pipe and the second conduit element being articulated at a second articulation point on the second telescopic pipe;

wherein the first and second articulation points alternately assume essentially transposed positions such that when the second telescopic pipe is retracted and extended between telescopic end positions, the first articulation point is moved past the second articulation point, and such that the conduit elements are extended against the direction of concrete conveyance in the retracted telescopic position and in the direction of concrete conveyance in the extended telescopic position.

7. The apparatus of claim 6, wherein the first telescopic pipe and the second telescopic pipe telescope along a telescopic axis, and wherein the first and second articulation points are positioned at different heights relative to the telescope axis, such that there is a space between paths followed by the first and second articulation points during the telescopic movement.

8. The apparatus of claim 6, wherein each conduit element comprises:

a straight central piece; and two end portions extending in a curve from the straight central piece to point in one direction;

wherein each conduit element forms a C-shape.

9. The apparatus of claim 6, wherein one or more of the conduit elements is spring-suspended from a corresponding telescopic pipe.

10. The apparatus of claim 6, wherein the telescopic distribution boom contains multiple telescopes and in that a pair of conduit elements is provided for each telescope.

* * * * *